US007854121B2

(12) United States Patent
Vandale et al.

(10) Patent No.: US 7,854,121 B2
(45) Date of Patent: Dec. 21, 2010

(54) INDEPENDENT PILOT FUEL CONTROL IN SECONDARY FUEL NOZZLE

(75) Inventors: Daniel D. Vandale, Greer, SC (US); Derrick Simons, Greer, SC (US); Alberto Jose Negroni, Simpsonville, SC (US); Carey Romoser, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 823 days.

(21) Appl. No.: 11/301,794

(22) Filed: Dec. 12, 2005

(65) Prior Publication Data

US 2007/0130955 A1 Jun. 14, 2007

(51) Int. Cl.
*F02C 1/00* (2006.01)
*F02G 3/00* (2006.01)

(52) U.S. Cl. ..... 60/740; 60/742

(58) Field of Classification Search ..... 60/733, 60/742, 740; 239/418, 422, 428, 423, 549
See application file for complete search history.

(56) References Cited

U.S. PATENT DOCUMENTS 4,179,880 A 12/1979 Schirmer ..... 60/39.23
4,467,610 A * 8/1984 Pearson et al. ..... 60/739
5,224,822 A * 7/1993 Lenahan et al. ..... 415/189
5,328,101 A * 7/1994 Munshi ..... 239/600
5,408,830 A * 4/1995 Lovett ..... 60/737
5,822,992 A * 10/1998 Dean ..... 60/737
6,026,644 A 2/2000 Ito et al.
6,691,516 B2 * 2/2004 Stuttaford et al. ..... 60/737
2004/0006993 A1 * 1/2004 Stuttaford et al. ..... 60/776
2005/0005610 A1 * 1/2005 Belsom et al. ..... 60/796
2005/0223713 A1 * 10/2005 Ziminsky et al. ..... 60/776

FOREIGN PATENT DOCUMENTS

CN 1098491 A 2/1995

OTHER PUBLICATIONS

Chinese First Office Action for CN Patent Application 200610064733.7, Filed on Dec. 12, 2006; Office Action Date of Issue Dec. 4, 2009.

* cited by examiner

*Primary Examiner*—Michael Cuff
*Assistant Examiner*—Andrew Nguyen
(74) *Attorney, Agent, or Firm*—Cantor Colburn LLP

(57) ABSTRACT

Disclosed herein is a fuel nozzle. The fuel nozzle includes a first fuel introduction location, a second fuel introduction location, and fuel passages. The first fuel introduction location is located radially about the fuel nozzle and is connected with a fuel passage. The second fuel introduction location is located at an end of the fuel nozzle and is connected with another fuel passage such that the fuel passage connected to the first fuel introduction location is separate from the fuel passage connected to the second fuel introduction location.

5 Claims, 5 Drawing Sheets

INDEPENDENT PILOT FUEL CONTROL IN SECONDARY FUEL NOZZLE

TECHNICAL FIELD

This application relates generally to gas turbines, and more specifically, to a secondary fuel nozzle for a gas turbine combustor with individually controlled fuel circuits intended to provide optimum combustion system emissions concentrations.

BACKGROUND OF THE INVENTION

A gas turbine combustor is essentially a device used for mixing fuel and air, and burning the resulting mixture. Gas turbine compressors pressurize inlet air which is then turned in direction or reverse flowed to the combustor where it is used to cool the combustor and also to provide air to the combustion process. Multiple combustion chamber assemblies may be utilized to achieve reliable and efficient turbine operation. Each combustion chamber assembly comprises a cylindrical combustor liner, a fuel injection system, and a transition piece that guides the flow of the hot gas from the combustor liner to the inlet of the turbine section. Gas turbines for which the present fuel nozzle design is to be utilized may include one combustor or several combustors arranged in a circular array about the turbine rotor axis.

Traditional gas turbine combustors use diffusion (i.e., non-premixed) combustion in which fuel and air enter the combustion flame zone separately and mix as they burn. The process of mixing and burning produces flame temperatures exceeding 3900° F. Because diatomic nitrogen rapidly disassociates and oxidizes at temperatures exceeding about 3000° F. (about 1650° C.), the high temperatures of diffusion combustion result in relatively high NOx emissions.

The ability to control the amount of fuel flow to different regions of the combustor allows for the minimizing of CO and NOx emissions for a given set of operating conditions.

Accordingly, there is a need for independent variable control of fuel flow to fuel introduction locations of the combustor as a means to further reduce emissions across full ambient ranges and gas turbine load ranges and provide an additional tuning level for enhanced operability optimization.

BRIEF SUMMARY OF THE INVENTION

Disclosed herein is a fuel nozzle. The fuel nozzle includes a first fuel introduction location, a second fuel introduction location, and fuel passages. The first fuel introduction location is located radially about the fuel nozzle and is connected with a fuel passage. The second fuel introduction location is located at an end of the fuel nozzle and is connected with another fuel passage such that the fuel passage connected to the first fuel introduction location is separate from the fuel passage connected to the second fuel introduction location.

Further disclosed herein is a gas turbine combustor. The gas turbine combustor includes a primary combustion chamber, a plurality of primary nozzles, a secondary combustion chamber, and a secondary nozzle. The plurality of primary nozzles are capable of delivering fuel to the primary combustion chamber. The secondary combustion chamber is downstream of the primary combustion chamber. And, the secondary nozzle is capable of delivering fuel to the secondary combustion chamber. The secondary nozzle has a plurality of individually controlled fuel circuits.

Yet further disclosed herein is a method for controlling fuel flow in a secondary fuel nozzle for a gas turbine combustor. A first fuel flow is conveyed to a reaction zone of the combustor. And a second fuel flow is conveyed to a downstream combustion chamber of the combustor such that the first fuel flow is controlled independently of the second fuel flow and the second fuel flow is controlled independently of the first fuel flow.

BRIEF DESCRIPTION OF THE DRAWINGS

Referring to the exemplary drawings wherein like elements are numbered alike in the accompanying Figures.

DETAILED DESCRIPTION OF THE INVENTION

Figure 1:
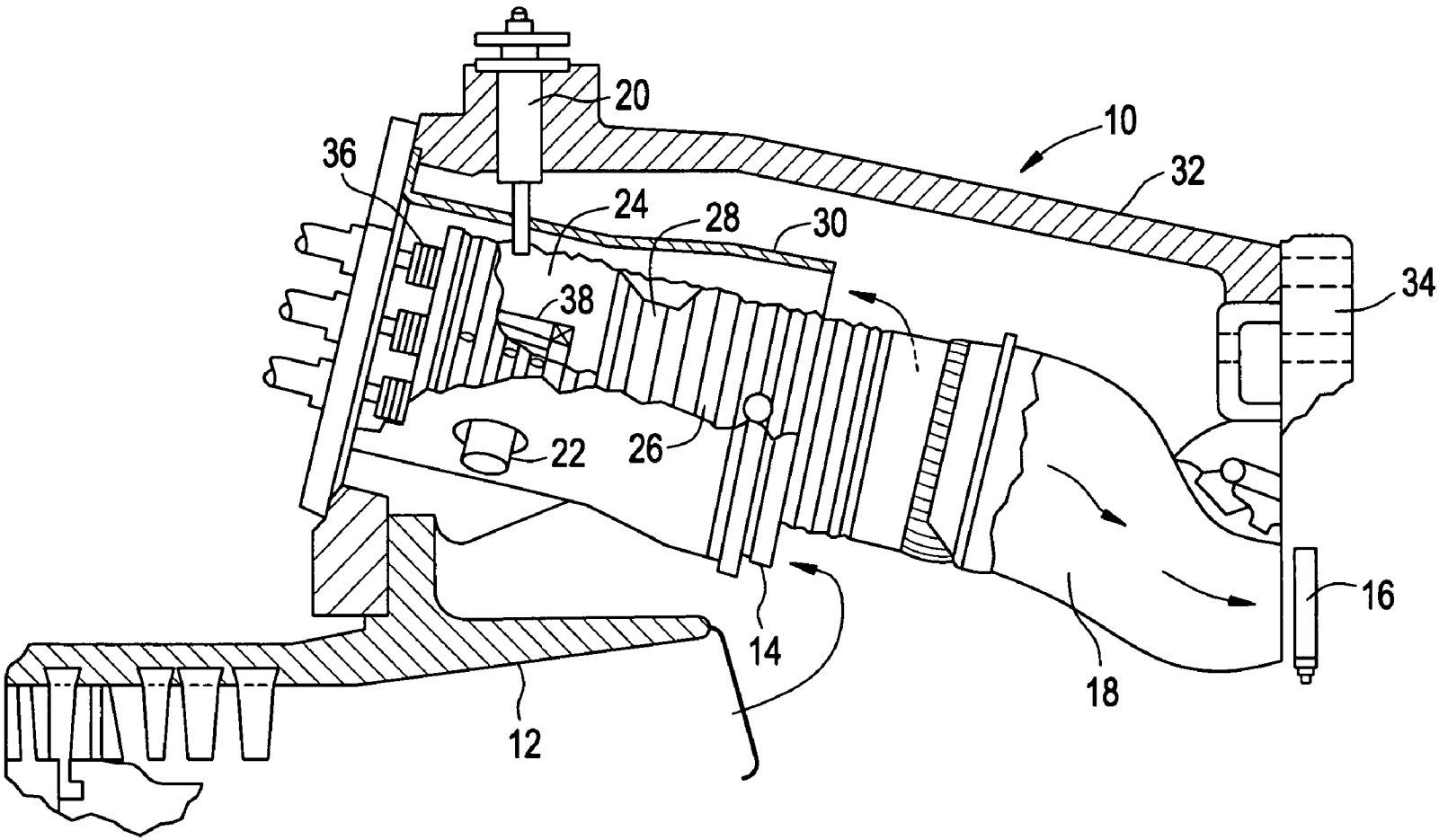
FIG. 1 is a partial cross section view of a gas turbine for use in accordance with an embodiment of the invention.

Referring to FIG. 1, a gas turbine 10 (partially shown) includes a compressor 12 (also partially shown), a plurality of combustors 14 (one shown), and a turbine section represented here by a single blade 16. Although not specifically shown, the turbine is drivingly connected to the compressor 12 along a common axis. The compressor 12 pressurizes inlet air which is then reverse flowed to the combustor 14 where it is used to cool the combustor and to provide air to the combustion process.

As noted above, the plurality of combustors 14 are located in an annular array about the axis of the gas turbine. A transition duct 18 connects the outlet end of each combustor 14 with the inlet end of the turbine to deliver the hot products of combustion to the turbine in the form of an approved temperature profile.

Each combustor 14 may comprise a primary or upstream combustion chamber 24 and a secondary or downstream combustion chamber 26 separated by a venturi throat region 28. The combustor 14 is surrounded by combustor flow sleeve 30 which channels compressor discharge air flow to the combustor 14. The combustor 14 is further surrounded by an outer casing 32 which is bolted to a turbine casing 34.

Primary nozzles 36 provide fuel delivery to the upstream combustor 24 and are arranged in an annular array around a central secondary nozzle 38. Ignition is achieved in the various combustors 14 by means of sparkplug 20 in conjunction with crossfire tubes 22 (one shown). The secondary nozzle 38 provides fuel delivery to the downstream combustion chamber 26.

Figure 2:
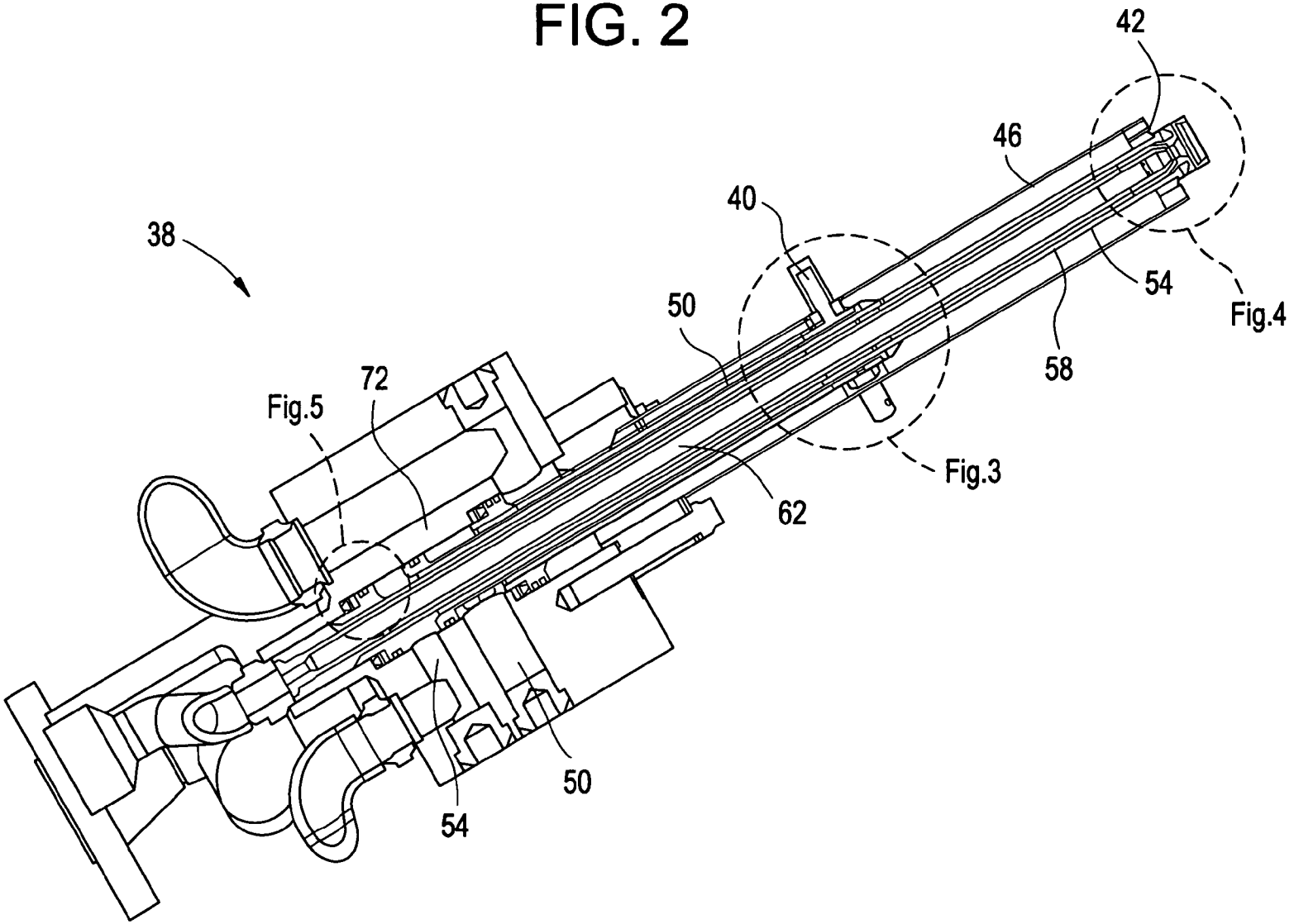
FIG. 2 is a side view of an exemplary secondary nozzle for use in accordance with an embodiment of the invention.

FIG. 2 illustrates an exemplary secondary nozzle 38 having two fuel introduction locations including secondary nozzle pegs 40 and a secondary nozzle pilot tip 42. The secondary nozzle pegs 40 provide fuel to a pre-mix reaction zone of the combustor 14, while the secondary nozzle pilot tip 42 provides fuel to the downstream combustion chamber 26 where it is immediately burned (diffusion combustion). The secondary nozzle 38 is a combustion system fuel delivery device having separate and individually controlled fuel circuits which allows for the ability to individually vary fuel flow rates delivered to the two fuel introduction locations (secondary nozzle pegs 40 and secondary nozzle pilot tip 42). For example, the fuel flow rate through the secondary nozzle pilot tip 42 may be varied independently from the fuel flow rate through the secondary nozzle pegs 40 and the fuel flow rate through the secondary nozzle pegs 40 may be varied independently from the fuel flow rate through the secondary nozzle pilot tip 42. Further, the secondary nozzle pegs 40 and the secondary nozzle pilot tip 42 each have their own independent fuel piping circuit, with each having independent and exclusive fuel sources. The fuel flow rate delivered to the secondary nozzle pilot tip 42 is less than about 2% of the total gas turbine fuel flow and is capable of, in one embodiment, delivering and controlling the fuel flow rate in the range of about 0.002 pps (pounds per second) to about 0.020 pps. Independent control of the two fuel introduction locations provides an additional degree of freedom which may be exercised to optimize the combustion system and minimize the CO and NOx emissions produced by the gas turbine system. In particular, the independent control of the two fuel introduction locations may achieve sub-5 ppm (parts per million) NOx emissions across the full ambient and load range. The fuel piping circuits and passages are described in greater detail below.

Figure 3:
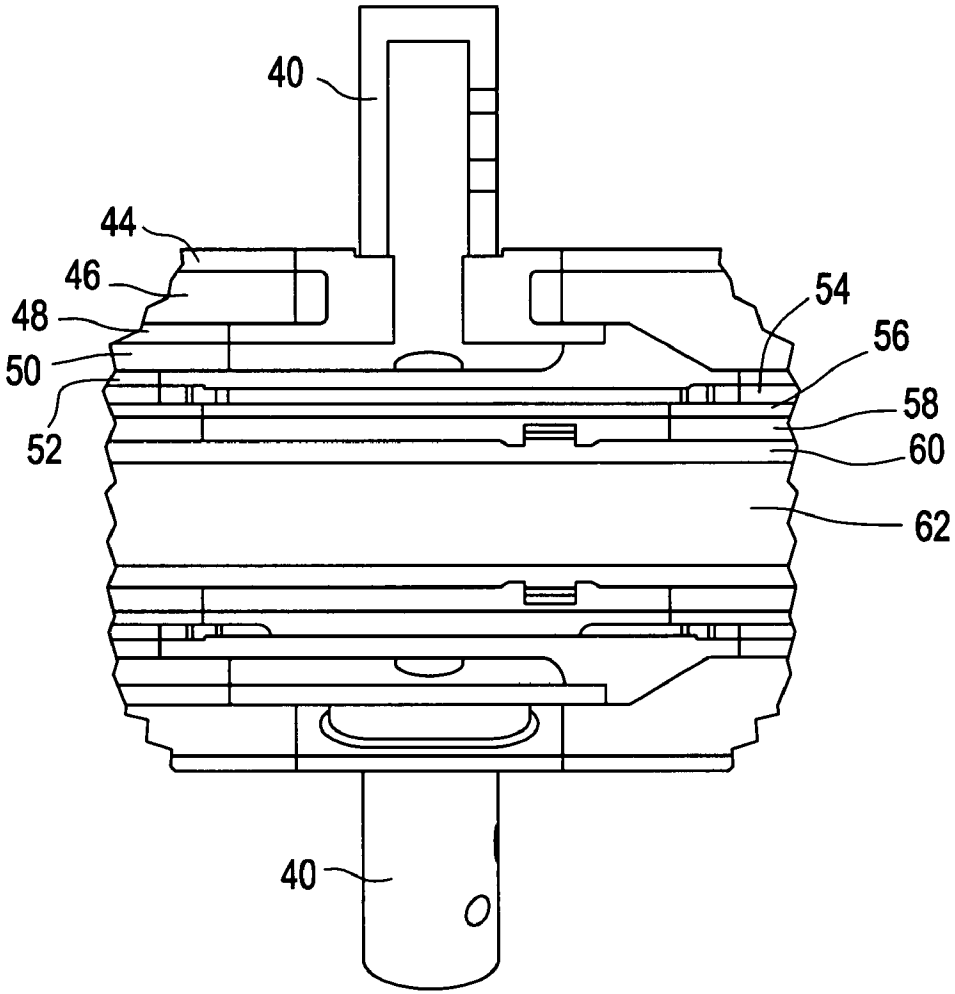
FIG. 3 is an enlarged view of a secondary nozzle peg area of the secondary nozzle of FIG. 2.

FIG. 3 further illustrates the secondary nozzle pegs 40 and the independent fuel circuits and passages. The secondary fuel nozzle 38 comprises a series of concentric tubes. The two radially outermost concentric tubes 44 and 48 provide a tertiary gas passage 46. The tertiary gas passage 46 provides tertiary gas to the secondary nozzle pilot tip 42.

A secondary gas fuel passage 50, adjacent to the tertiary gas passage 46, is formed between concentric tubes 48 and 52. The secondary gas fuel passage 50 communicates with the plurality of radially extending secondary nozzle pegs 40 arranged about the circumference of the secondary nozzle 38 and supplies secondary gas fuel to the secondary nozzle pegs 40.

A sub-pilot gas fuel passage 54, adjacent to the secondary gas fuel passage 50, is defined between concentric tubes 52 and 56. The sub-pilot gas fuel passage 54 supplies sub-pilot gas fuel to the secondary nozzle pilot tip 42.

A water purge passage 58, adjacent to the sub-pilot gas fuel passage 54, is defined between concentric tubes 56 and 60. The water purge passage 58 provides water to the secondary nozzle pilot tip 42 to effect carbon monoxide (CO) and nitrogen oxide (NOx) emission reductions.

A liquid fuel passage 62, the innermost of the series of concentric passages forming the secondary nozzle 38, is defined by tube 60. The liquid fuel passage 62 provides liquid fuel to the secondary nozzle pilot tip 42.

Additionally, although FIG. 2 shows four independent fuel circuits, it should be noted that the number of fuel circuits may be varied according to operational and design considerations.

Figure 4:
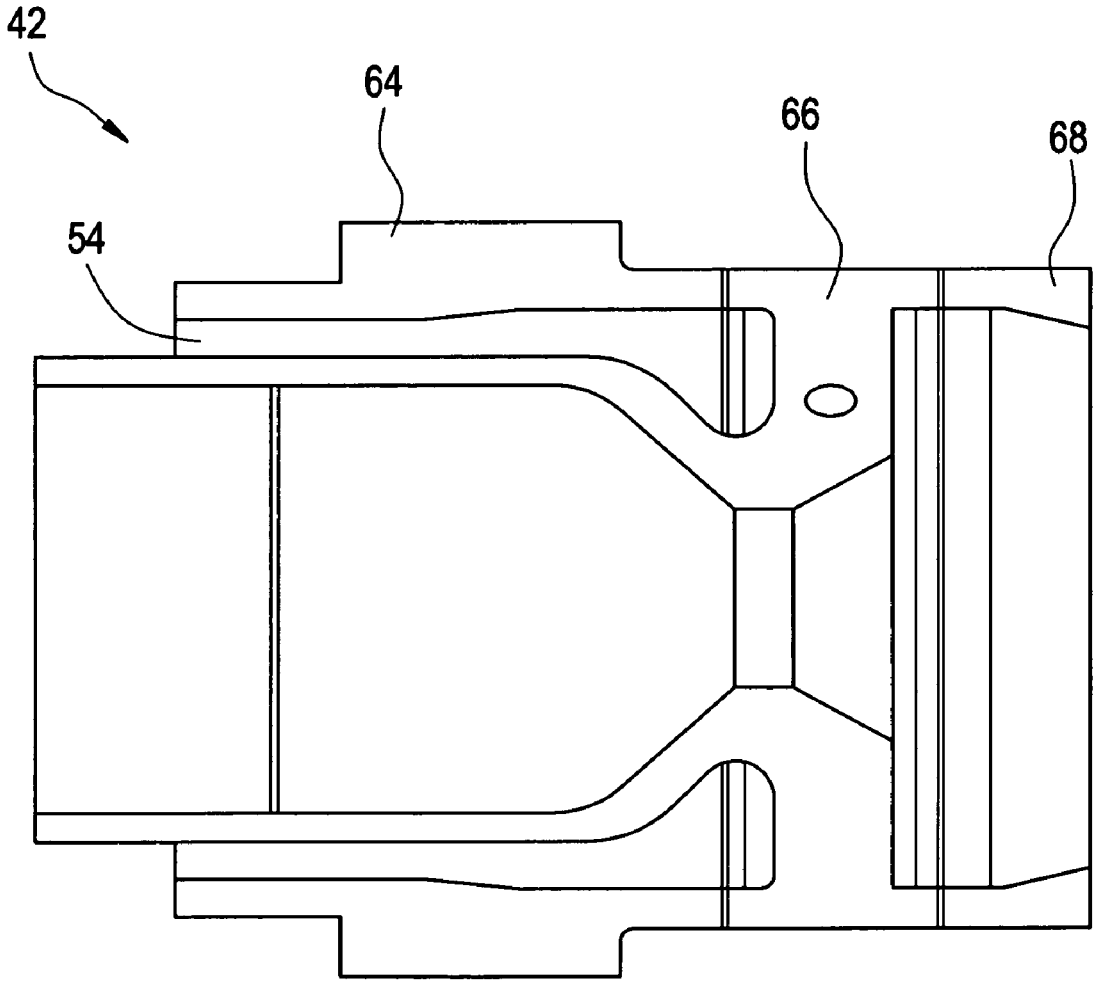
FIG. 4 is an enlarged view of a secondary nozzle pilot tip of the secondary nozzle of FIG. 2; and, FIG. 5 is an enlarged view of a lip seal region of the secondary nozzle of FIG. 2.

FIG. 4 further illustrates the secondary nozzle pilot tip 42. The secondary nozzle pilot tip 42, in one embodiment, may be a three piece assembly having a sub-pilot portion 64, which contains the sub-pilot gas fuel at the secondary nozzle pilot tip 42 and abuts tube 52, a water purge portion 66, which contains the water at the secondary nozzle pilot tip 42 and abuts tube 56, and a tip portion 68, which forms an outlet end to the secondary nozzle 38. The three piece secondary nozzle pilot tip may be fixedly joined, for example, by an electron beam welding process.

Figure 5:
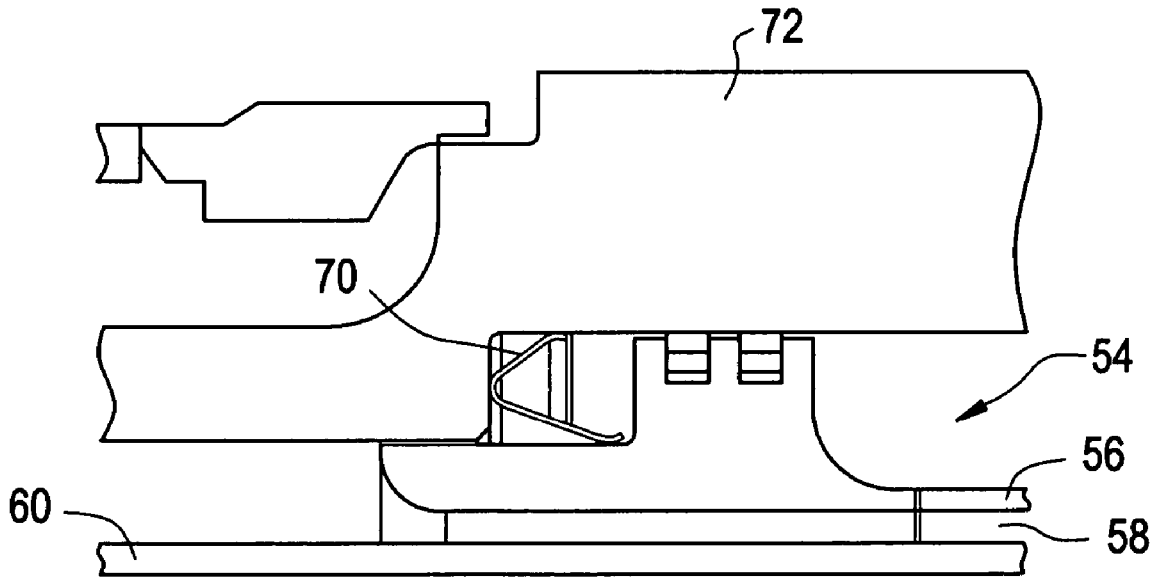

FIG. 5 illustrates a lip seal 70 between tube 56 and a secondary nozzle base 72. The lip seal 70 prevents fuel leakage within the secondary nozzle 38 by forming a controlled interference fit between the tube 56 and the secondary nozzle base. It will be appreciated that lip seals 70 may be utilized between other fuel passage defining tubes (other than tube 56) and the secondary nozzle base 72 as required to prevent fuel leakage.

While the invention has been described with reference to a preferred embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims.

What is claimed is:

1. A fuel nozzle comprising:

a base portion having a first chamber, a second chamber, a third chamber and a fourth chamber;

a first tube engaging the base portion;

a second tube having a flange portion engaging the base portion, the second tube disposed concentrically about the first tube;

a third tube having a flange portion engaging the base portion, the third tube disposed concentrically about the second tube;

a fourth tube engaging the base portion, the fourth disposed concentrically about the third tube;

a first passage defined by an outer surface of the first tube and an inner diameter of the second tube, the first passage communicative with the first chamber and a first introduction port located at the distal end of the fuel nozzle;

a second passage defined by an outer surface of the second tube and an inner diameter of the third tube, the second passage communicative with the second chamber and a plurality of second introduction ports disposed radially about the fuel nozzle;

a third passage defined by an inner diameter of the first tube, the third passage communicative with the third chamber and a third introduction port located at a distal end of the fuel nozzle;

a fourth passage defined by an outer surface of the third tube and an inner diameter of the fourth tube, the fourth passage communicative with the fourth chamber and a distal end of the fuel nozzle, wherein the distal end is opposite the fourth chamber; and a first lip seal disposed concentrically around the second tube and engaging the base portion, the first lip seal including a ring portion having a planar surface and a flange portion extending from the planar surface, the flange portion contacting the second tube, the first lip seal operative to prevent leakage between the second passage and the first passage.

2. The fuel nozzle of claim 1, wherein the second chamber is communicative with a first fuel source.

3. The fuel nozzle of claim 1, wherein the first chamber is communicative with a source of purging fluid.

4. The fuel nozzle of claim 2, wherein the third chamber is communicative with a second fuel source.

5. The fuel nozzle of claim 2, wherein the third chamber is communicative with a second fuel source, the second fuel source separate from the first fuel source.

* * * * *